US005348184A

United States Patent [19]

Adams et al.

[11] Patent Number: 5,348,184

[45] Date of Patent: Sep. 20, 1994

[54] UNITARY TAMPER-EVIDENT FITMENT AND CLOSURE ASSEMBLY

[75] Inventors: Brian M. Adams, Newark; Daniel Luch, Los Gatos; Rawson Chenault, Newark, all of Calif.

[73] Assignee: Portola Packaging, Inc., San Jose, Calif.

[21] Appl. No.: 961,088

[22] Filed: Oct. 14, 1992

Related U.S. Application Data

[63] Continuation-in-part of Ser. No. 823,200, Jan. 21, 1992, Pat. No. 5,303,837, and a continuation-in-part of Ser. No. 780,774, Oct. 22, 1991, Pat. No. 5,174,465, which is a continuation of Ser. No. 13,258, Feb. 3, 1993, Pat. No. 5,249,695, which is a continuation of Ser. No. 664,658, Mar. 5, 1991, abandoned.

[51] Int. Cl.[5] ..... B65D 41/32; B65D 41/62

[52] U.S. Cl. ..... 220/266; 220/256; 220/276; 220/359; 215/213; 215/253; 229/125.15; 222/562; 222/569

[58] Field of Search ..... 220/254, 256, 265, 266, 220/270, 276, 307, 359; 215/211, 213, 216, 232, 250, 253, 306; 229/125.15, 125.17; 222/545, 562, 569

[56] References Cited

U.S. PATENT DOCUMENTS

| | | | |
|---|---|---|---|
| Re. 32,891 | 3/1989 | Smith | 229/179 |
| 2,168,608 | 8/1939 | O'Brien et al. | 221/23 |
| 3,021,976 | 2/1962 | Tracy | 220/254 X |
| 3,199,748 | 8/1965 | Bross | 220/266 X |
| 3,204,829 | 9/1965 | Song | 222/153 |
| 3,282,477 | 11/1966 | Henchert | 222/541 |
| 3,744,675 | 7/1973 | Song | 222/153 |
| 3,998,354 | 12/1976 | Song | 220/269 |
| 4,146,148 | 3/1979 | Dwinell et al. | 220/270 |
| 4,362,255 | 12/1982 | Bond | 222/107 |
| 4,399,924 | 8/1983 | Nilsson | 220/257 |
| 4,483,464 | 11/1984 | Nomura | 222/83 |
| 4,657,143 | 4/1987 | Forbes, Jr. | 206/626 |
| 4,669,640 | 6/1987 | Ando et al. | 222/541 |
| 4,705,197 | 11/1987 | Gordon et al. | 222/545 |
| 4,770,325 | 9/1988 | Gordon et al. | 222/481 |
| 4,813,578 | 3/1989 | Gordon et al. | 222/541 |
| 4,830,273 | 5/1989 | Kalberer et al. | 229/123.1 |
| 4,890,770 | 1/1990 | Haga et al. | 222/109 |
| 4,909,434 | 3/1990 | Jones et al. | 229/125.15 |
| 4,913,292 | 4/1990 | Field | 206/611 |
| 4,934,547 | 6/1990 | Mayes et al. | 215/306 |
| 4,949,882 | 8/1990 | Take | 222/528 |
| 4,964,562 | 10/1990 | Gordon | 229/125 |
| 5,012,941 | 5/1991 | Abrams et al. | 215/250 |
| 5,012,959 | 5/1991 | Gordon | 222/535 |
| 5,020,690 | 6/1991 | Kishikawa et al. | 222/83 |
| 5,108,029 | 4/1992 | Abrams et al. | 229/125.09 |
| 5,137,260 | 8/1992 | Pehr | 215/216 |
| 5,174,465 | 12/1992 | Luch et al. | 220/288 |
| 5,176,300 | 1/1993 | Kishikawa et al. | 222/541 |

*Primary Examiner*—Allan N. Shoap
*Assistant Examiner*—Vanessa Caretto
*Attorney, Agent, or Firm*—Julian Caplan

[57] ABSTRACT

A tamper-evident thermoplastic fitment having a spout and a closure for said spout are welded to a polymer-coated paperboard container or to a flexible plastic container. The fitment and closure are initially molded simultaneously but with a substantial space between the two parts interconnected by an elongated runner which conducts molten plastic from the closure to the fitment. Upon retraction of the core of the mold, the closure is pulled into the spout until shoulders on the parts engage, whereupon the closure is stripped from the mold core. The runner comprises a tear tab which slides through an apertured space on the closure. When the parts engage tangs on the tear tab engage the space, making the assembly tamper-evident. The fitment has a flange which may be welded or otherwise secured to the container. The tab may be pulled by the consumer to open the container. The closure may be unscrewed from the spout or otherwise disengaged.

22 Claims, 3 Drawing Sheets

UNITARY TAMPER-EVIDENT FITMENT AND CLOSURE ASSEMBLY

CROSS REFERENCES TO RELATED APPLICATIONS

This application is a continuation-in-part of co-pending U.S. application Ser. No. 07/823,200, filed Jan. 21, 1992, now U.S. Pat. No. 5,303,837; Ser. No. 07/780,774, filed Oct. 22, 1991, now U.S. Pat. No. 5,174,465; which is a continuation of Ser. No. 08/013,258 filed Feb. 3, 1993, now U.S. Pat. No. 5,249,695, which is a continuation of Ser. No. 07/664,658, filed Mar. 5, 1991, now abandoned. The disclosures of all said applications and patents are incorporated herein by reference.

BACKGROUND OF THE INVENTION

1. Field of the Invention

This invention relates to a new and improved spout fitment and a plug type cap for closing same. More particularly, the invention relates to a fitment which fits around a hole in a panel of a paperboard carton or around a hole in a flexible container such as used for packaging liquid products and powders and to a closure for such fitment. The invention is further characterized in that it is tamper evident. More particularly, the invention relates to a unitary fitment and closure molded in a single mold wherein the cap and the fitment are molded axially spaced apart. An elongated tear tab (which is one of the elements of the tamper-evident feature of the assembly) extends from the fitment up to the cap and functions during the molding process as a "runner." In other words, plastic material flows into the portion of the mold which forms the cap, thence down the tear tab runner and finally into the portion of the mold which forms the fitment. The cap may be assembled with the fitment as part of the molding process in that as the core of the mold retracts, the cap is drawn along with the core and assembles the two components together. The cap is then stripped from the core since the cap can move no further.

The invention is applicable to aseptic packaging wherein a separate piece of foil or plastic material is welded to the inner wall of the container and likewise to the underside of the flange of the fitment and to the underside of the bottom edge of the cap. If the container is then filled with a sterile product, the sterility will be preserved until the cap is removed from the spout by the consumer.

2. Description of the Related Art

Generally speaking, prior fitments have spouts formed with external threads closed by caps with internal threads. Some fitments are used in conjunction with plastic bag containers, the fitment being integrally welded to the plastic bag. Other prior art fitments are attached to a polymer-coated paperboard container, such as a gable-top, half-gallon container which, optionally, may be lined with foil or plastic. Prior art fitments for paperboard cartons usually include a thin flange which is welded to the polymer-coated paperboard surface of the container.

It will be understood that instead of a screw thread attachment of the cap to the spout of the fitment, a snap-on, snap-off attachment may be used. Such an attachment has been previously used in the fitment art.

Aseptic packaging has been used in the metal container and glass container industries. The container and closure are made sterile and the container is filled with a sterile product under sterile conditions. The present invention enables this principle to be used with paperboard cartons or other barrier containers.

Fitments of the prior art have a number of deficiencies as compared to the present invention. In the first place, they employ multiple components which increase the cost of the combination very greatly over the simple structure of the present invention. Secondly, the assembly is difficult and often involves rotary equipment which is difficult to control in practice and is expensive to install. Thirdly, because of the fact that the prior art spouts are externally threaded, the diameter of the opening in the spout is restricted inasmuch as there is only limited space on the panel of the container on which the flange can be located, thereby reducing the diameter of the fitment flange and correspondingly the internal diameter of the spout. Fourthly, commercially available fitment closure combinations have no external tamper-evident features, demonstrated, for example, by the internal foil seal of the spout opening of the prior art.

The openings in prior container panels have been closed by barrier layers, such as shown in U.S. Pat. No. 4,813,578. Such barrier layers are, however, usually part of the laminate of which the container panel is formed. Portions of the plug or cap are secured to the barrier so that when the plug is removed, the barrier is fractured, providing access to the interior of the container. The use of the laminate as the barrier involves manufacturing difficulties which do not occur in accordance with the present invention.

All of the foregoing deficiencies are eliminated in the present invention.

SUMMARY OF INVENTION

In accordance with the present invention, a fitment having a spout into which the skirt of the cap fits is provided. Either the spout and cap skirt are formed with mating threads or the telescoping surfaces are so formed that they are liquid tight when assembled.

A feature of the present invention is that the cap and fitment are molded in a single cavity, and the portion of the cavity which forms the cap is spaced from the portion which molds the fitment. The two portions are interconnected by a runner which ultimately comprises an elongated tear tab for the tamper-evident features of the assembly of cap and spout. The tab may be made long enough to be conveniently gripped by the consumer by reason of the fact that the two mold cavity portions are spaced apart.

Another feature of the present invention is the fact that the core which forms the interior of the cap, as it moves downward relative to the spout, pulls the cap with it and assembles the cap and spout together by the time the molding operation is completed. For such purposes, the interior of the cap may be formed with an internal ring which seats in a groove in the mold core and prevents dislodgment of the core from the cap until the completion of the assembly operation.

Another feature of the present invention is the fact that the connection between the runner (tear tab) and the cap is frangible and ruptures through a subgating design. Thus as the core moves the cap toward the fitment, the tear tab slides relative to the cap. When the two components are assembled together, locking lugs on the tab slip through a hole in a flange extension of the cap to lock the system together in a tamper-evident manner. The fitment is then inserted through the hole in the container, and the flange of the fitment is welded to the container.

The consumer grips the tear tab (which may be elongated because of the manner in which the parts are molded) and breaks the connection of the tear tab with the fitment, thereby giving evidence of tampering.

In one form of the present invention, a foil disk of greater diameter than the flange of the fitment is attached to the underside of the flange by welding, and the foil is also welded to the bottom edge of the plug which fits into the spout of the fitment. The assembled fitment and plug are inserted through the opening in the container panel from the underside of the container and the foil is welded to the underside of the container panel in liquid-tight fashion. This construction is useful in aseptic packaging, since the sealing of the foil to the container panel around the opening in the container prevents contamination of the interior of the container after filling.

In one form of the invention instead of threads on the fitment and cap skirt, mating seals are provided which inter-engage when the cap is seated in the fitment preventing leakage.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
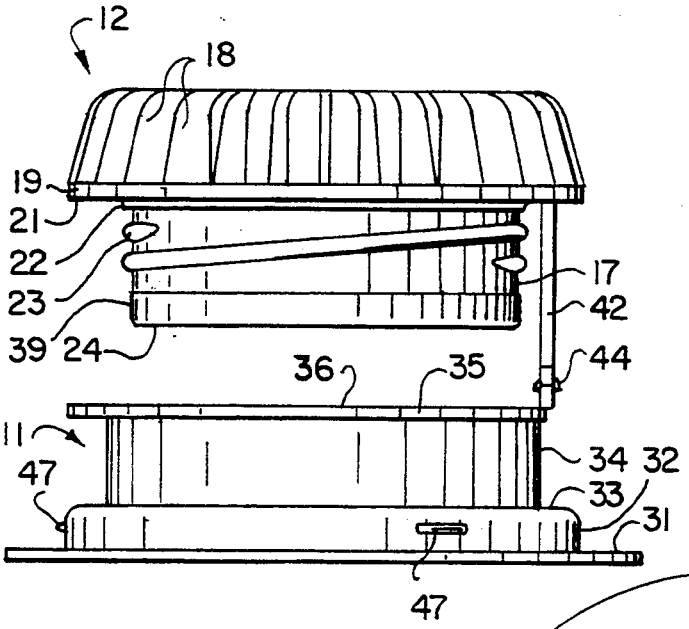
FIG. 1 is a side elevational view of the cap and fitment at the stage of the molding operation where molding is completed but prior to retraction of the mold core.
Figure 2:
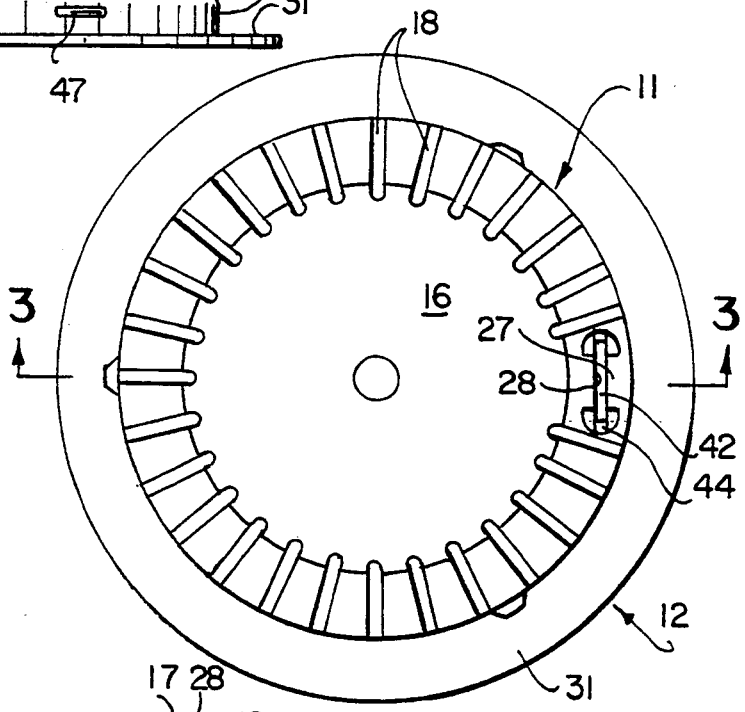
FIG. 2 is a top plan view of the structure of FIG. 1.
Figure 3:
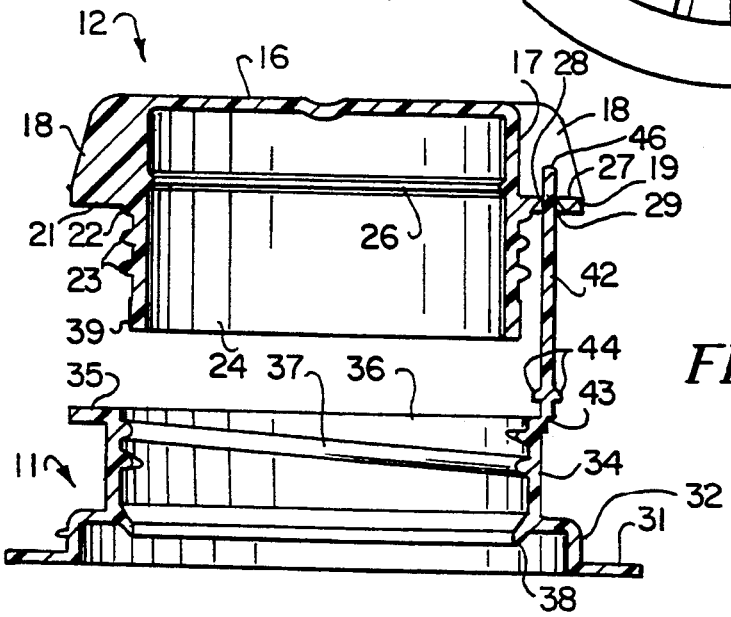
FIG. 3 is a sectional view taken substantially along the line 3—3 of FIG. 2.

As shown in FIG. 1, as molded, fitment 11 and cap 12 are spaced apart, the portion of the mold cavity which molds the fitment being connected to the portion of the cavity which molds the cap by means of a runner which, as hereinafter explained, comprises the tear tab 42. As the core of the mold (not shown) retracts, the cap is pulled down to the position shown in FIG. 4, the tear tab 42 sliding upwardly relative to the cap 12.

In the form of the invention shown in FIGS. 1 to 4, cap 12 comprises a top 16 from the periphery of which depends skirt 17. The exterior of the upper half of skirt 17 is formed with external vertical ribs 18 which assist the user in unscrewing the cap after assembly. An outward extending flange 19 is formed at the lower ends of the ribs 18 having a shoulder 21 on its underside. Immediately below shoulder 21 is a seat 22 which comprises an enlargement on the exterior of skirt 17. External threads 23 are formed on the portion of skirt 17 below the seat 22. Cap 12 terminates in a lower, bottom edge 24; and one of the features of the present invention is the fact that the external surface 39 of the skirt above bottom edge 24 is smooth so that it may seal against the fitment 11 in assembled position.

Optionally, internal bead 26 is formed on skirt 17 just above the level of flange 19. The bead 26 is formed by a groove in the core (not shown) of the mold. The function of the bead 26 is the insure that the cap 12 retracts with the core just prior to the completion of the molding operation.

At one location there is a space 27 between ribs 18 which is a flat surface on the top of flange 19 formed with an aperture 28. The underside of space 27 is formed with a bevel 29 below aperture 28.

The fitment portion 11 comprises an annular flange 31 having an upward offset 32 at its inner edge merging into an annular rim 33 parallel to flange 31. Extending up from the inner edge of rim 33 is spout 34 which has an upper edge 36 with a peripheral flange 35 dimensioned to fit against the shoulder 21 in the assembled position shown in FIG. 4. The seat 22 of cap 12 fits immediately inside the upper edge of the spout 34. Internal threads 37 are formed on the interior of spout 34 shaped to mesh with the threads 23. The materials of which the fitment 11 and cap 12 are molded are sufficiently flexible so that when the cap 12 is pulled down relative to the fitment 11, the threads 23 and 37 slip past each other and then interengage.

A seal ring 38 slants downward-inward to engage the smooth surface 39 on the exterior of skirt 17 below threads 23. The primary seal of the fitment and cap is preferably the seal of surface 38 with smooth surface 39.

Projecting outward at the upper end of spout 34 immediately below edge 36 is a flange 35 and extending vertically upwardly in alignment with aperture 28 is tear tab 42 which, as heretofore explained, functions as a runner to deliver molten plastic from the cap to the fitment during the molding process. A notch 43 is made in the outer, lower corner of the juncture of flange 35 and tab 42 so that the tab 42 may be torn off. So long as the tab 42 is connected to fitment 11, however, the assembly shown in FIG. 4 is tamper evident.

Extending outwardly and inwardly of tab 42 above upper edge 36, at a distance slightly greater than the thickness of space 27, are tangs 44. When the two parts are drawn together as shown in FIG. 4, tangs 44 slip through the aperture 28 and lock above the space 27 preventing the parts from being disassembled so long as the tab 42 is attached to the fitment 11.

Figure 4:
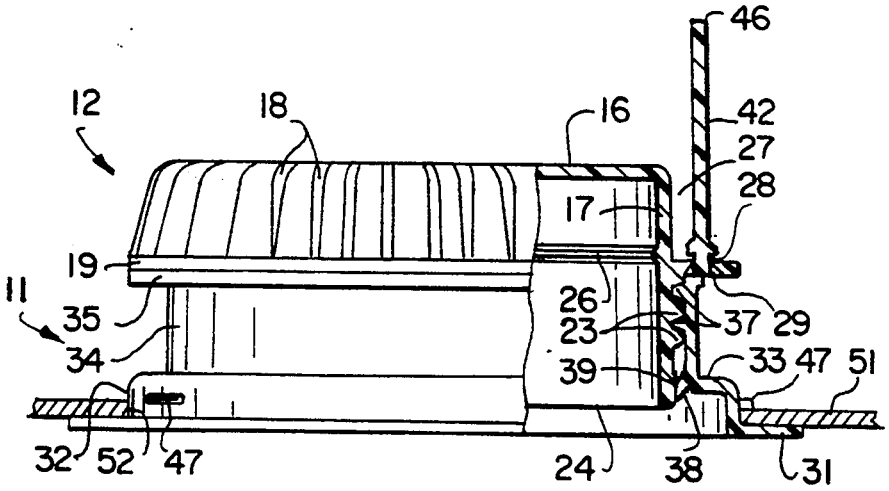
FIG. 4 is a side elevational view of the cap and spout assembled together and installed on a container, the view being partially broken away in section to reveal internal construction.

Directing attention to FIG. 4, the assembly of fitment 11 and cap 12 may be installed on a panel of container 51 having a hole 52 dimensioned therein which is approximately equal to the outside diameter of offset 32. Preferably the assembly of fitment and cap is inserted through hole 52 from below panel 51 as viewed in FIG.

4. Projections 47 on offset 32 engage the top surface of container 51 to hold fitment 11 in place. The flange 31 is welded or otherwise permanently secured to the polymer surface of container panel 51.

To open the container, the user pulls the tab 42, fracturing the connection at the notch 43 and then unscrews cap 12.

During the molding operation, plastic fills the portion of the cavity forming the cap 12 and runs down the tear tab 42 which acts as a runner. The molten plastic then fills the lower portion of the cavity which forms the fitment 11. It will be understood by those skilled in the art of plastic molding that there is a core (not shown) on the interior of the cap 12 during the molding operation. The internal bead 26 fills a circumferential groove in such core. As the molding operation terminates, the core retracts and because the bead 26 fits into the groove in the core, the cap 12 is pulled downward toward the fitment 11. The section above the bevel 29 is ruptured during this downward movement so that the space 27 slides down the tear tab 42. No plastic falls into the product because of bevel 29. As the parts move to the final position shown in FIG. 4, the tangs 44 fit through the aperture 28 and snap outward against the top surface of space 27. Since the flange 19 seats on the upper edge 36 of the spout 34, continued retraction of the core of the mold causes the bead 26 to escape from the groove in the core.

Figure 6:
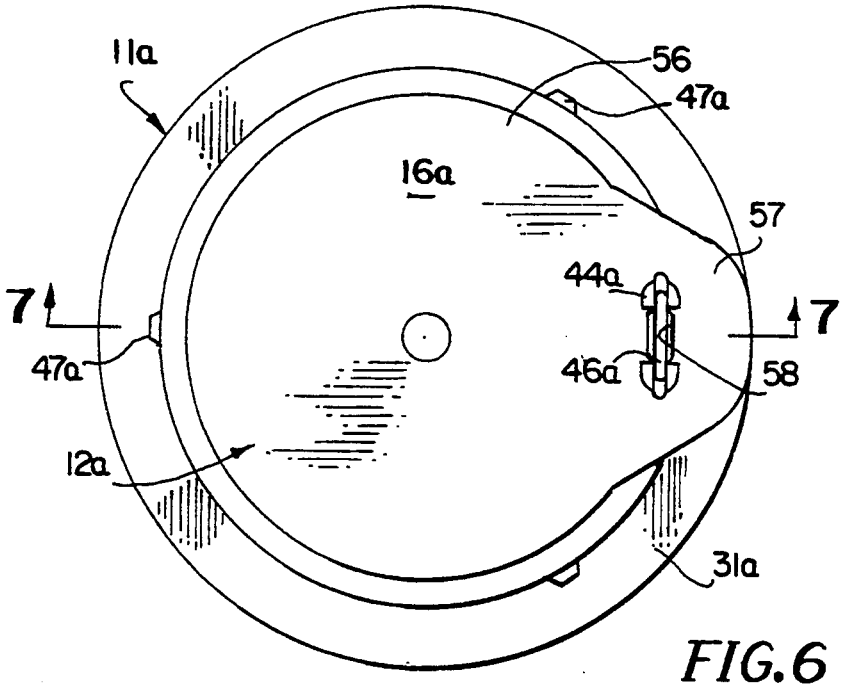
FIG. 6 is a top plan view of the structure of FIG. 5.
Figure 7:
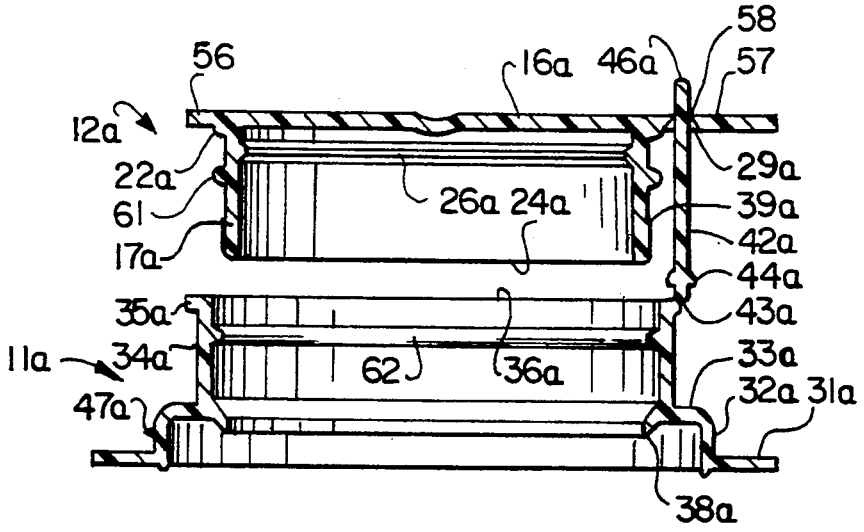
FIG. 7 is a vertical sectional view taken substantially along the line 7—7 of FIG. 6.
Figure 8:
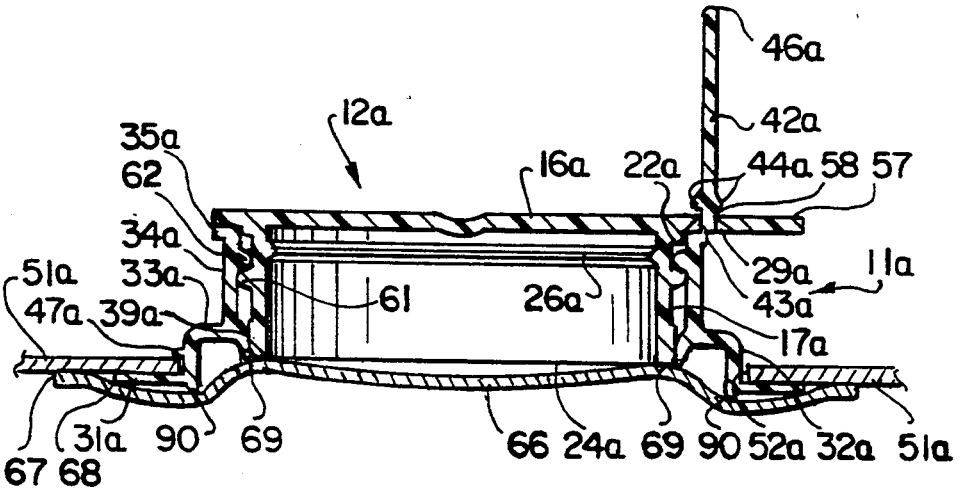
FIG. 8 is an enlarged vertical, sectional view of the assembled structure of FIG. 7 applied to a container panel and also showing an aseptic foil attached thereto.

Directing attention now to the modification of the invention shown in FIGS. 5–8, the threads 23 and 37 of the preceding modification are eliminated. Skirt **17*a* of cap 12*a* has an external retention bead 61 formed thereon while the interior of spout 34*a* has an internal retention bead 62 formed therein. When the cap 12*a* is seated in the fitment 11*a*, as best shown in FIG. 8, the beads 61 and 62** fit tightly against each other.

Top **16*a* is formed with a peripheral flange 56 which seats upon a peripheral flange 35*a* on the top edge 36*a* of fitment 11*a*. At one location tab 57 projects outwardly and is formed with an aperture 58 shaped to receive tear tab 42*a*. When the cap is seated in the fitment as shown in FIG. 8, the tangs 44*a* rest on the upper surface of tab 57. The tab 57 has an additional use: It may be used to remove the cap 16*a* from the fitment spout 34*a*** when it is necessary to dispense the contents of the container.

FIG. 8 shows a further modification of the invention. The container is further sealed with a foil 66. Aseptic or hermetic packaging can be achieved in this way. In the embodiment of FIG. 8, the disk of foil 66 is larger than the exterior of flange **31*a*. This foil 66 may be of a metal or plastic composition. Adjacent the outer edge of foil 66, it is attached, for example by means of weld 67 to the underside of the container wall 51*a* and is also welded to the underside of flange 31*a* and preferably to the bottom edge of skirt 17*a*. When the container is filled with sterile product, the disk 66 keeps the container sterile during transportation and storage. When the cap 12*a* is removed, the weld 69 is preferably sufficiently secure so that the foil which would otherwise block the aperture is removed along with the cap. Teeth or sharp serrations 90 may be incorporated to assist rupture of the foil so that the removal force is not excessive. In addition, attachment means other than welds (i.e. adhesives or mechanical attachment) can be employed to achieve the joining at 67 and 69**.

Figure 5:
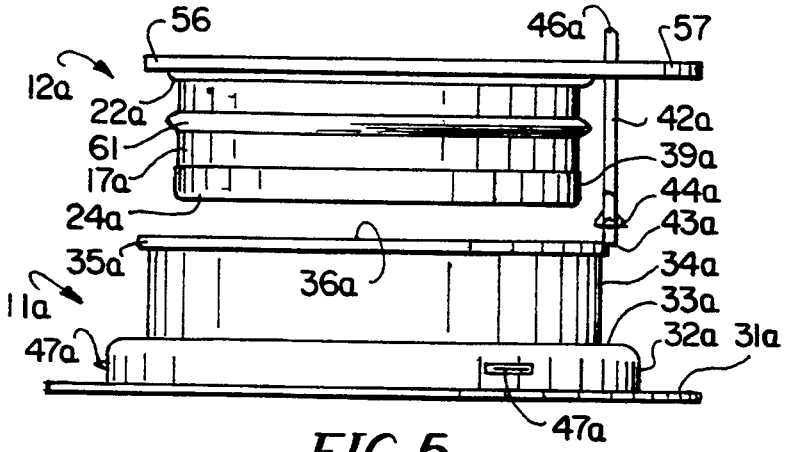
FIG. 5 is a view similar to FIG. 1 of a modification.

It will be understood that FIG. 8 shows the aseptic foil 66 applied to the structure of FIGS. 5–7. However, it will be understood that the same principle may be used in connection with a modification of FIGS. 1–4.

In other respects the modification of FIGS. 5–8 resembles that of the preceding modification and the same reference numerals followed by the subscript a are used to designate corresponding parts.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. An intermediate product comprising in combination, a cap and a fitment, said cap comprising a top, a skirt depending from said top, means forming an aperture extending outward from said skirt, and first engagement means on said skirt, said skirt having an interior and an exterior, said fitment comprising fastening means for fastening said fitment to a container surrounding a hole formed in said container, a spout defining an orifice extending upward from said fastening means shaped when said cap and fitment are assembled to receive a portion of said skirt and having second engagement means cooperable with said first engagement means to detachably secure said cap and fitment together, said spout having an interior and an exterior, an elongated tab attached to said fitment extending up to at least a bottom edge of said means forming an aperture and located directly beneath and initially attached to said means forming an aperture with a frangible connection, said tab being spaced outwardly of said orifice, said tab comprising a runner for flow of molten plastic from said cap to said fitment during molding of said combination, said skirt being axially aligned with and spaced from said spout prior to assembly of said cap and fitment.

2. The intermediate product of claim 1 wherein said tab extends upward from said fitment through said aperture.

3. The intermediate product of claim 1 in which said cap and said fitment have mutually engageable first and second tamper-evidencing means respectively, said first and second tamper-evidencing means being shaped and positioned to engage when said cap skirt is seated in said fitment spout, at least one of said first and second tamper-evidencing means being frangible whereby said cap cannot be removed from said spout without fracturing said frangible tamper-evidencing means.

4. The intermediate product of claim 3 in which said first tamper-evidencing means is said aperture and said second tamper-evidencing means comprises said tab.

5. The intermediate product of claim 4 in which said tab is slidable within said aperture, said tab fitting closely within said aperture, said second tamper-evidencing means further comprising tangs on said tab positioned and shaped to slip through said aperture and engage said means forming an aperture on a side remote from said fitment to restrain separation of said closure from said fitment when said cap and fitment are assembled so long as said tab is attached to said fitment, said tab being connected to said fitment at a second area of weakness.

6. The intermediate product of claim 1 wherein said means forming an aperture comprises a flange extending outwardly of said cap.

7. The intermediate product of claim 1 which further comprises internal engagement means on said skirt interior.

8. The intermediate product of claim 7 which further comprises first and second shoulders on said skirt and said fitment, said shoulders positioned and shaped to engage each other when said skirt is moved into said spout to limit movement of said skirt into said spout.

9. The intermediate product of claim 1 in which said first and second engagement means comprise mating threads.

10. The intermediate product of claim 9 in which first engagement means are external threads and said second engagement means are internal threads.

11. The intermediate product of claim 1 having first and second seal means, said first seal means comprising a smooth cylindrical surface adjacent a lower end of said skirt and said second seal means comprising a downward-inward extending ring on said interior of said spout to seal against said cylindrical surface.

12. The intermediate product of claim 1 in which said fastening means comprises an outer annular portion shaped and positioned to fit against an underside of said container, an offset portion on an inner edge of said outer annular portion adapted to fit through said hole and an annular rim joining an upper edge of said offset portion to said spout.

13. The intermediate product of claim 1 in which said first engagement means comprises a first bead on said exterior of said skirt and said second engagement means comprises a second bead on an interior of said spout positioned to fit tightly over said first bead in an assembled position of said cap and said fitment.

14. The intermediate product of claim 1 which further comprises a sealing foil attached to said fitment positioned to cover said orifice.

15. The intermediate product of claim 14 wherein said foil is attached to said fastening means.

16. The intermediate product of claim 15 which further comprises means to assist in rupture of said foil when said cap is initially removed from said spout.

17. The intermediate product of claim 16 wherein said assist means comprise at least one serration located above said foil.

18. The intermediate product of claim 15 wherein said foil is larger than said fastening means, said foil projecting beyond said fastening means whereby said foil may be attached directly to said container.

19. The intermediate product of claim 14 wherein said foil is attached to the bottom edge of said skirt.

20. The intermediate product of claim 1 wherein said first and second engagement means produce a disengageable interference snap engagement.

21. In combination, a container, a cap and a fitment, said container being formed with a hole and having an inside and an outside, said cap comprising a top, a skirt depending from said top, means forming an aperture extending outward, and first engagement means on said skirt, said skirt having an interior and an exterior, said fitment comprising fastening means fastening said fitmerit to said container surrounding said hole, a spout extending upward from said fastening means receiving a portion of said skirt and having second engagement means cooperable with said first engagement means to detachably secure said cap and fitment together, an elongated tab attached to said fitment extending through said aperture and attached to said fitment with a frangible connection, said fastening means comprising an outer annular portion having a top surface which fits against an inside surface of said container, an offset portion on a radially inner edge of said outer annular portion fitting upwardly and radially inwardly through said hole and an annular rim joining an upper edge of said offset portion to said spout.

22. The combination of claim 21 which further comprises a plurality of projections on said offset portion extending outwardly to engage the outside of said container.

* * * * *